US010946655B2

(12) United States Patent
Ishihara et al.

(10) Patent No.: US 10,946,655 B2
(45) Date of Patent: Mar. 16, 2021

(54) NOZZLE HEAD AND DROPLET APPLICATION DEVICE

(71) Applicant: KABUSHIKI KAISHA TOSHIBA, Minato-ku (JP)

(72) Inventors: Haruhiko Ishihara, Yokohama (JP); Shizuo Kinoshita, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 16/353,267

(22) Filed: Mar. 14, 2019

(65) Prior Publication Data

US 2020/0079087 A1 Mar. 12, 2020

(30) Foreign Application Priority Data

Sep. 12, 2018 (JP) ..... JP2018-170706

(51) Int. Cl.
*B41J 2/14* (2006.01)
*B41J 2/16* (2006.01)

(52) U.S. Cl.
CPC ..... *B41J 2/14274* (2013.01); *B41J 2/1433* (2013.01); *B41J 2/1623* (2013.01); *B41J 2002/14491* (2013.01)

(58) Field of Classification Search
None
See application file for complete search history.

(56) References Cited

U.S. PATENT DOCUMENTS 4,751,774 A 6/1988 Deyoung et al.
4,768,266 A 9/1988 Deyoung
(Continued)

FOREIGN PATENT DOCUMENTS

JP 4-235041 A 8/1992
JP 2007-83563 A 4/2007
(Continued)

OTHER PUBLICATIONS

Furuhata, Katsutoshi, Oscillating Object, Piezoelectric Actuator, Electronic Equipment, and Method of Manufacturing of Oscillating Object, Dec. 2007, Japan (Year: 2007).*

*Primary Examiner* — Erica S Lin
*Assistant Examiner* — Tracey M McMillion
(74) *Attorney, Agent, or Firm* — Oblon, McClelland, Maier & Neustadt, L.L.P.

(57) ABSTRACT

According to one embodiment, a nozzle head includes a nozzle plate, a piezoelectric element, an actuator plate, a fixing part, and a conductive part. The nozzle plate includes a plurality of nozzle holes. The piezoelectric element includes a plurality of first electrodes and a plurality of second electrodes provided alternately and a piezoelectric part provided between the plurality of first electrodes and the plurality of second electrodes. The piezoelectric element is provided for each of the plurality of nozzle holes. The actuator plate is provided on opposite side of the nozzle plate from a side to which the plurality of nozzle holes are opened. The fixing part is insulative and provided between each of a plurality of the piezoelectric elements and the actuator plate. The conductive part is conductive and provided between each of a plurality of the piezoelectric elements and the actuator plate.

18 Claims, 6 Drawing Sheets

(56) References Cited

U.S. PATENT DOCUMENTS

| | | | | |
|---|---|---|---|---|
| 6,209,994 | B1 * | 4/2001 | Furuhata | B41J 2/14233 310/330 |
| 2004/0195569 | A1 * | 10/2004 | Hashimoto | H01L 29/78603 257/69 |
| 2006/0066675 | A1 * | 3/2006 | Ito | B41J 2/14201 347/50 |
| 2006/0209111 | A1 * | 9/2006 | Usui | B41J 2/165 347/14 |
| 2010/0246067 | A1 * | 9/2010 | Fujimoto | G11B 5/4873 360/246.1 |
| 2011/0273518 | A1 * | 11/2011 | Sato | B41J 2/14274 347/70 |

FOREIGN PATENT DOCUMENTS

| | | | |
|---|---|---|---|
| JP | 2007330036 | A | * 12/2007 |
| JP | 2010-110968 | A | 5/2010 |
| JP | 2011-235533 | | 11/2011 |
| JP | 2016-55544 | A | 4/2016 |

* cited by examiner

NOZZLE HEAD AND DROPLET APPLICATION DEVICE

CROSS-REFERENCE TO RELATED APPLICATIONS

This application is based upon and claims the benefit of priority from Japanese Patent Application No. 2018-170706, filed on Sep. 12, 2018; the entire contents of which are incorporated herein by reference.

FIELD

Embodiments described herein relate generally to a nozzle head and a droplet application device.

BACKGROUND

A film formation device is used to manufacture e.g. printers and other printing devices, liquid crystal display devices, or semiconductor devices. In some devices such as the film formation device, a liquid material such as ink and film material is turned to droplets and discharged toward a target. In this case, in general, the viscosity of the droplet (liquid material) is made relatively low. For instance, the viscosity of the droplet is made less than 20 mPa·s.

However, in recent years, it has been desired to enable discharging of droplets having higher viscosity.

DETAILED DESCRIPTION

Figure 1:
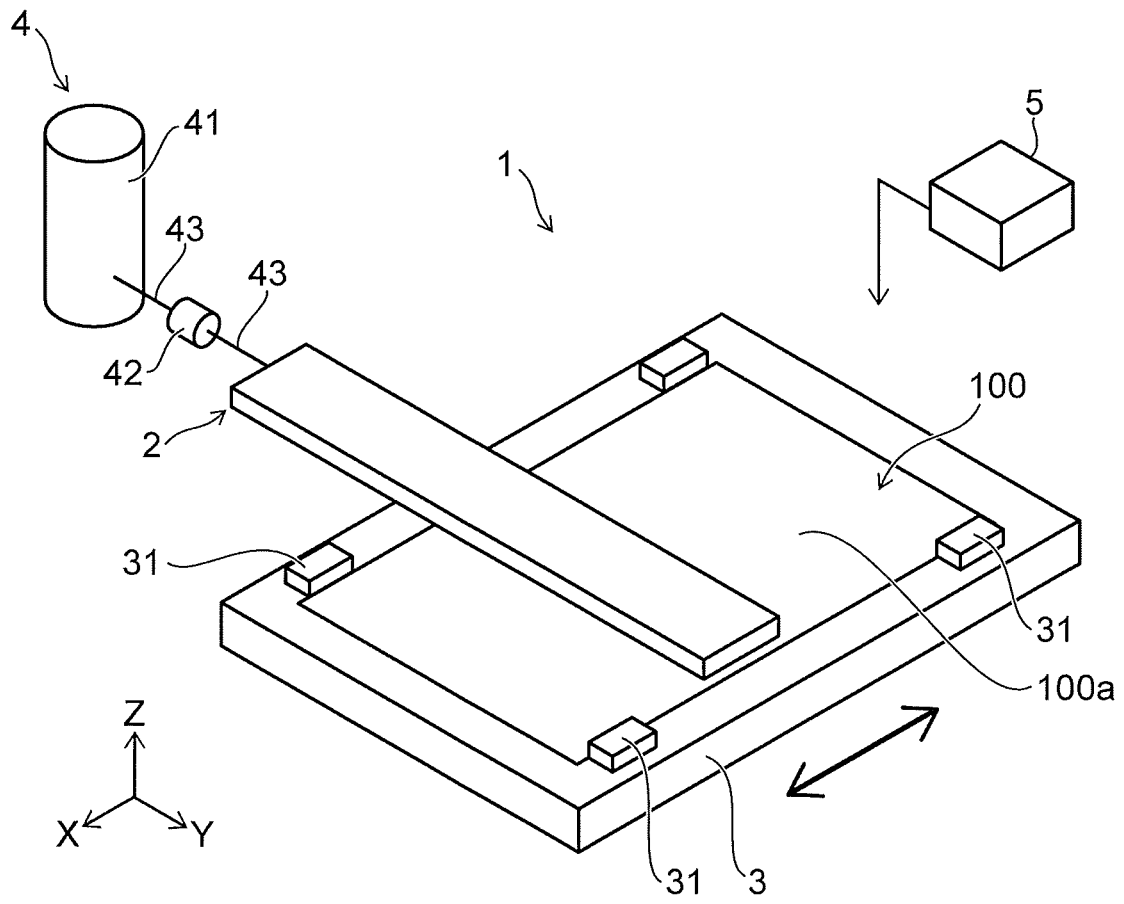
FIG. 1 is a schematic perspective view for illustrating a droplet application device according to the embodiment.

A nozzle head according to an embodiment comprises a nozzle plate, a piezoelectric element, an actuator plate, a fixing part, and a conductive part. The nozzle plate includes a plurality of nozzle holes capable of discharging droplets. The piezoelectric element includes a plurality of first electrodes and a plurality of second electrodes provided alternately and a piezoelectric part provided between the plurality of first electrodes and the plurality of second electrodes. The piezoelectric element is provided for each of the plurality of nozzle holes. The actuator plate is provided on opposite side of the nozzle plate from a side to which the plurality of nozzle holes are opened. The fixing part is insulative and provided between each of a plurality of the piezoelectric elements and the actuator plate. The conductive part is conductive and provided between each of a plurality of the piezoelectric elements and the actuator plate.

Embodiments will now be illustrated with reference to the drawings. In the drawings, the same elements are marked with the same reference numerals, and the detailed description thereof is omitted as appropriate.

FIG. 1 is a schematic perspective view for illustrating a droplet application device 1 according to the embodiment.

Arrows X, Y, and Z in FIG. 1 represent three directions orthogonal to each other. For instance, the vertical direction is the Z-axis direction, one direction in the horizontal plane is the X-axis direction, and the direction perpendicular to the Z-axis direction and the X-axis direction is the Y-axis direction.

Figure 2:
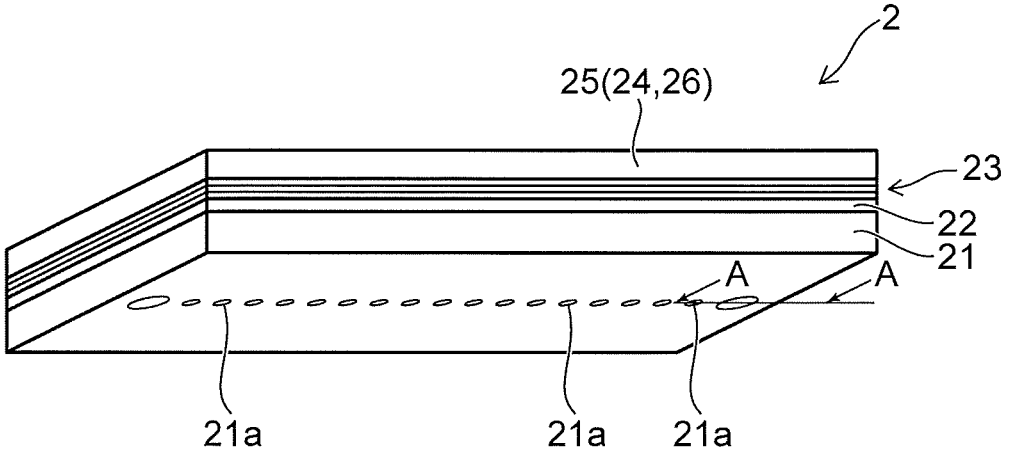
FIG. 2 is a schematic perspective view of a nozzle head.

FIG. 2 is a schematic perspective view of a nozzle head 2.

Figure 3:
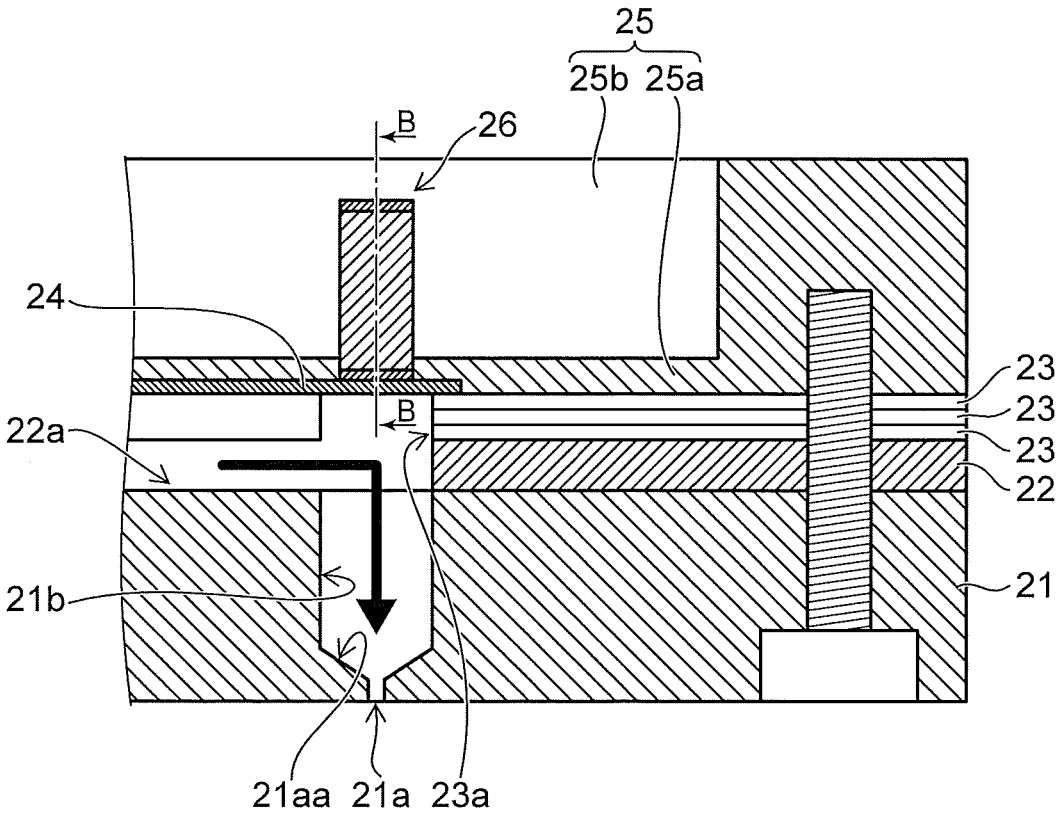
FIG. 3 is a schematic sectional view taken along line A-A of the nozzle head in FIG. 2.

FIG. 3 is a schematic sectional view taken along line A-A of the nozzle head 2 in FIG. 2.

Figure 4:
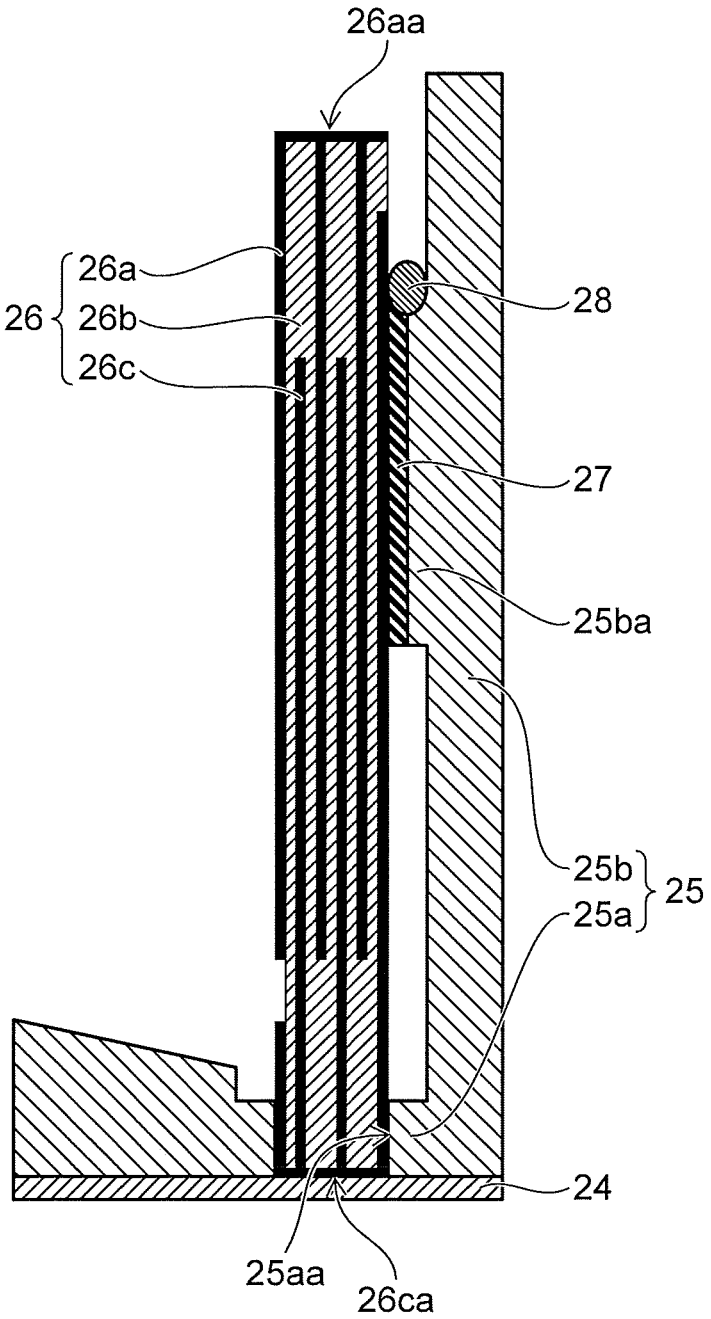
FIG. 4 is a schematic sectional view for illustrating an actuator plate and a piezoelectric element.

FIG. 4 is a schematic sectional view for illustrating an actuator plate 25 and a piezoelectric element 26. FIG. 4 is a schematic sectional view taken along line B-B of the actuator plate 25 and the piezoelectric element 26 in FIG. 3.

Figure 5:
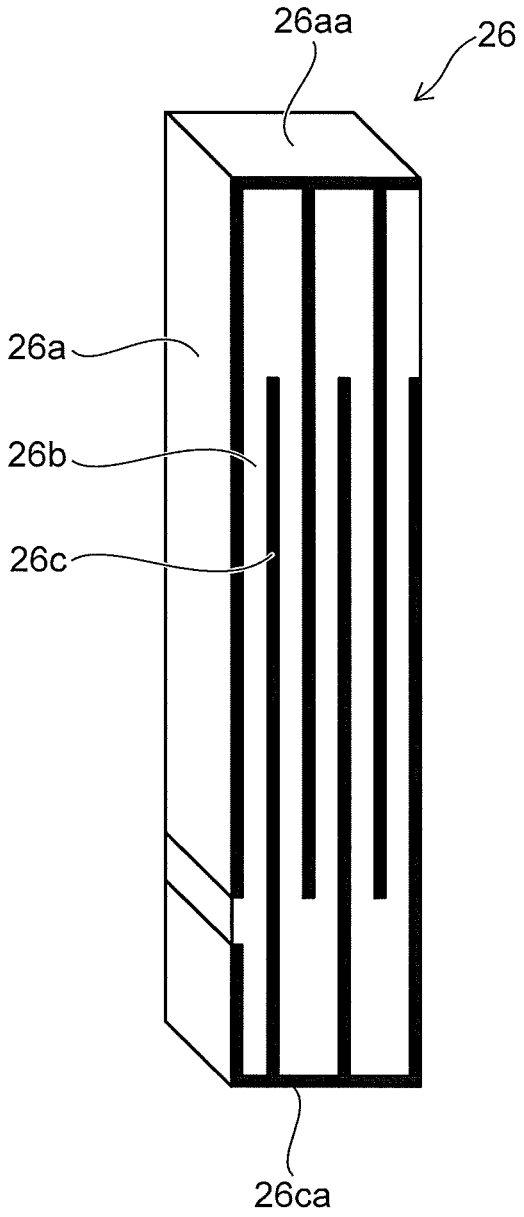
FIG. 5 is a schematic perspective view for illustrating the piezoelectric element.

FIG. 5 is a schematic perspective view for illustrating the piezoelectric element 26.

As shown in FIG. 1, the droplet application device 1 is provided with a nozzle head 2, a mounting part 3, a supply part 4, and a controller 5.

As shown in FIGS. 2 and 3, the nozzle head 2 is a nozzle head of what is called the multi-nozzle type including a plurality of nozzle holes 21*a*. The nozzle head 2 is also a nozzle head of the "piezoelectric type" that discharges droplets with the help of the bending displacement of the piezoelectric element 26.

The nozzle head 2 is provided with a nozzle plate 21, a flow channel plate 22, a seal plate 23, a diaphragm 24, an actuator plate 25, a piezoelectric element 26, a fixing part 27, and a conductive part 28.

The nozzle plate 21 has a configuration extending in a prescribed direction. The nozzle plate 21 can be configured like e.g. a rectangular solid. The material of the nozzle plate 21 can be appropriately selected from e.g. resin, metal, and semiconductor material having corrosion resistance to the discharged liquid material. The nozzle plate 21 can be formed from e.g. stainless steel or nickel alloy.

In this specification, the "liquid material" is not limited to only liquid, but may be any material that is granulated when being discharged from the nozzle hole 21*a*. For instance, the liquid material can be e.g. liquid or gel-like material. The "droplet" in this specification refers to a granulated liquid material.

However, the nozzle head 2 according to this embodiment can discharge a liquid material of high viscosity that is difficult to discharge by a commonly-used nozzle head. For instance, the nozzle head 2 according to this embodiment can discharge droplets having a viscosity of 20 mPa·s or more.

The viscosity of the droplet discharged by the nozzle head 2 can be set to e.g. 20 mPa·s or more.

The nozzle plate 21 includes a plurality of liquid chambers 21*b*. The plurality of liquid chambers 21*b* can be provided at e.g. an equal pitch. The plurality of liquid chambers 21*b* are opened to one end surface of the nozzle plate 21. A taper part 21*aa* is provided at the other end of the liquid chamber 21*b* (the bottom surface of the liquid chamber 21*b*). The cross-sectional dimension of the taper part 21*aa* in the direction orthogonal to its central axis gradually decreases toward the nozzle hole 21*a* side. The angle of the taper part 21*aa* can be set to 30° or more and 150° or less.

The nozzle plate 21 further includes a plurality of nozzle holes 21*a* capable of discharging droplets. One end of the nozzle hole 21*a* is connected to the taper part 21*aa*. The other end of the nozzle hole 21*a* is opened to the end surface of the nozzle plate 21 on the opposite side from the flow channel plate 22 side. That is, the liquid chamber 21*b* and the nozzle hole 21*a* are connected through the taper part 21*aa*.

The nozzle hole 21*a* and the liquid chamber 21*b* can be shaped like e.g. a circular cylinder. The diameter of the nozzle hole 21*a* can be set to e.g. approximately 20-50 μm. The diameter of the liquid chamber 21*b* can be set to e.g. approximately 250-600 μm.

The flow channel plate 22 is provided on the end surface of the nozzle plate 21 on the side to which the plurality of liquid chambers 21*b* are opened. The flow channel plate 22 has a configuration extending in a prescribed direction. The flow channel plate 22 can be configured like e.g. a rectangular solid. The planar shape and the planar dimension of the flow channel plate 22 can be made identical to the planar shape and the planar dimension of the nozzle plate 21. The flow channel plate 22 is provided with a hole 22*a* penetrating in the thickness direction. The hole 22*a* is provided at a position opposed to the plurality of liquid chambers 21*b*. The hole 22*a* serves as a flow channel when the liquid material supplied from the supply part 4 flows into the plurality of liquid chambers 21*b*. In this example, the plurality of liquid chambers 21*b* are connected to one hole 22*a* (flow channel). However, each of the plurality of liquid chambers 21*b* may be connected to a dedicated hole 22*a* (flow channel).

The material of the flow channel plate 22 can be made e.g. identical to the material of the nozzle plate 21.

The flow channel plate 22 is not necessarily needed, but the flow channel may be provided in the nozzle plate 21.

The seal plate 23 is provided in a plurality between the nozzle plate 21 and the actuator plate 25. The seal plate 23 has a configuration extending in a prescribed direction. The seal plate 23 can be configured like e.g. a rectangular solid. The planar shape and the planar dimension of the seal plate 23 can be made identical to the planar shape and the planar dimension of the nozzle plate 21. The seal plate 23 is provided with a plurality of holes 23*a* penetrating in the thickness direction. Each of the plurality of holes 23*a* is provided at a position opposed to the liquid chamber 21*b*. The hole 23*a* is provided to transmit the pressure wave caused by the bending displacement of the piezoelectric element 26 to the liquid material in the liquid chamber 21*b*. The material of the seal plate 23 can be made e.g. identical to the material of the nozzle plate 21.

Here, as shown in FIG. 3, the nozzle plate 21 is fixed to the actuator plate 25 with a fastening member such as a screw. The nozzle plate 21 and the actuator plate 25 have a configuration extending in the prescribed direction. Thus, if the neighborhoods of their end parts are fixed with a fastening member, at least one of the nozzle plate 21 and the actuator plate 25 may be subjected to deflection or warpage. If at least one of the nozzle plate 21 and the actuator plate 25 is subjected to deflection or warpage, the adjacent liquid chambers 21*b* may be connected through an interstice. Then, mutual interference may occur between the adjacent piezoelectric elements 26 or between the adjacent liquid chambers 21*b*.

Thus, the nozzle head 2 according to this embodiment is provided with a plurality of seal plates 23. The thickness of the seal plate 23 is thinner than the thickness of the nozzle plate 21. Preferably, the thickness of the seal plate 23 is set to e.g. 0.1 mm or less. A plurality of seal plates 23 having a thin thickness thus provided can generate an interstice between the seal plates 23 when at least one of the nozzle plate 21 and the actuator plate 25 is subjected to deflection or warpage. That is, a large interstice generated by deflection or warpage can be dispersed into a plurality of small interstices by forming an interstice between the seal plates 23. The small interstice has a larger flow channel resistance than the large interstice. This can suppress mutual interference between the adjacent piezoelectric elements 26 or between the adjacent liquid chambers 21*b*.

The number of seal plates 23 can be appropriately changed depending on e.g. the deformation amount of the nozzle plate 21. For instance, the deformation amount of the nozzle plate 21 is denoted by S (μm), and the number of seal plates 23 is denoted by N. Then, it is preferable to satisfy $S/N \leq 10$.

The diaphragm 24 is provided on the opposite side of the plurality of seal plates 23 from the flow channel plate 22 side. The diaphragm 24 covers the plurality of holes 23*a* provided in the seal plates 23. The diaphragm 24 may be provided, one for each hole 23*a*. The material and the thickness of the diaphragm 24 are not particularly limited as long as it can be bent by the piezoelectric element 26. The material of the diaphragm 24 can be e.g. polyethylene terephthalate. The thickness of the diaphragm 24 can be set to e.g. approximately 10 μm.

The actuator plate 25 is provided on the opposite side of the nozzle plate 21 from the side to which the plurality of nozzle holes 21*a* are opened.

As shown in FIG. 4, the actuator plate 25 includes a base part 25*a* and a support part 25*b*. The base part 25*a* and the support part 25*b* can be formed integrally.

The base part 25*a* is provided on the opposite side of the plurality of seal plates 23 from the flow channel plate 22 side. In this case, the base part 25*a* can be provided so as to cover the diaphragm 24. The base part 25*a* has a configuration extending in a prescribed direction. The planar shape and the planar dimension of the base part 25*a* can be made identical to the planar shape and the planar dimension of the nozzle plate 21. The base part 25*a* is provided with a plurality of holes 25*aa* penetrating in the thickness direction. Each of the plurality of holes 25*aa* is provided at a position opposed to the liquid chamber 21*b*. One end part of the piezoelectric element is inserted into the hole 25*aa*. One end part of the piezoelectric element 26 is in contact with the diaphragm 24.

The support part 25*b* is provided on the longitudinal side of the base part 25*a*. The support part 25*b* is shaped like a plate and extends in the arranging direction of the plurality of holes 25*aa*. The support part 25*b* can be made generally perpendicular to the surface of the base part 25*a* on the seal plate 23 side.

The material of the actuator plate 25 (the base part 25*a* and the support part 25*b*) can be made e.g. identical to the material of the nozzle plate 21.

The piezoelectric element 26 can be shaped like e.g. a rectangular solid. The piezoelectric element 26 is provided in a plurality on the opposite side of the diaphragm 24 from the seal plates 23 side. The end part of the piezoelectric element 26 inserted into the hole 25*aa* is in contact with the diaphragm 24. The piezoelectric element 26 is provided, one for each of the liquid chambers 21*b*. In this case, preferably, the piezoelectric element 26 is provided in the central axis direction of the liquid chamber 21*b*. For instance, the piezoelectric element 26 can be provided directly above the liquid chamber 21*b*. That is, preferably, the central axis of the nozzle hole 21*a*, the central axis of the liquid chamber 21*b*, and the central axis of the piezoelectric element 26 are placed on one straight line. The piezoelectric element 26 provided in such a position facilitates transmitting the pressure wave caused by the bending displacement of the piezoelectric element 26 to the liquid material in the liquid chamber 21*b*.

As shown in FIGS. 4 and 5, the piezoelectric element 26 is provided with a plurality of electrodes 26*a* (corresponding to an example of first electrodes), a plurality of piezoelectric parts 26*b*, and a plurality of electrodes 26*c* (corresponding to an example of second electrodes). The plurality of electrodes 26*a* and the plurality of electrodes 26*c* can be provided generally parallel to the support part 25*b*. One electrode 26*c* is opposed to one electrode 26*a*. The plurality of electrodes 26*a* and the plurality of electrodes 26*c* are provided alternately. The plurality of electrodes 26*a* are electrically connected to each other. For instance, the end parts of the plurality of electrodes 26*a* on the opposite side from the diaphragm 24 side are electrically connected through a connection part 26*aa*. The plurality of electrodes 26*c* are electrically connected to each other. For instance, the end parts of the plurality of electrodes 26*c* on the diaphragm 24 side are electrically connected through a connection part 26*ca*.

Each of the plurality of piezoelectric parts 26*b* is provided at least between the electrode 26*a* and the electrode 26*c*.

The cross-sectional area of the piezoelectric element 26 in the direction orthogonal to the central axis of the liquid chamber 21*b* can be made comparable to or less than the cross-sectional area of the liquid chamber 21*b* in the direction orthogonal to the central axis.

Preferably, the extrusion amount is set to e.g. $0.06\times10^{-3}$ $mm^3$ or more when the viscosity of the droplet is 20 mPa·s. In this case, the extrusion amount is the product of the cross-sectional area of the piezoelectric element 26 in the direction orthogonal to the central axis of the liquid chamber 21*b* and the displacement amount of the piezoelectric element 26.

The relationship between the viscosity of the droplet and the extrusion amount will be described later in detail.

The material of the plurality of electrodes 26*a* and the material of the plurality of electrodes 26*c* can be e.g. a conductive material such as copper alloy. The material of the plurality of piezoelectric parts 26*b* can be e.g. a piezoelectric ceramic such as lead zirconate titanate. The piezoelectric element 26 can be formed by integrally firing a plurality of electrodes 26*a*, a plurality of piezoelectric parts 26*b*, and a plurality of electrodes 26*c*. In the piezoelectric element 26 provided with the plurality of electrodes 26*a*, the plurality of piezoelectric parts 26*b*, and the plurality of electrodes 26*c*, the number of positions generating the electric field can be increased by the number of pairs of the electrodes 26*a* and the electrodes 26*c*. Thus, compared with the piezoelectric element including one electrode 26*a*, one piezoelectric part 26*b*, and one electrode 26*c*, equal or larger displacement can be obtained even when the application voltage is lowered.

The number of the plurality of electrodes 26*c* can be made equal to the number of the plurality of electrodes 26*a*. In this case, preferably, the number of the plurality of electrodes 26*a* is set to an odd number. Preferably, the number of the plurality of electrodes 26*c* is set to an odd number. Then, the number of the plurality of electrodes 26*a* and the number of the plurality of electrodes 26*c* are odd. In this case, the electrode 26*a* can be provided on the surface (one side surface) of the piezoelectric element 26 crossing the surface on the diaphragm 24 side, and the electrode 26*c* can be provided on the surface (the other side surface) opposed to the surface provided with the electrode 26*a*. This facilitates electrically connecting the plurality of electrodes 26*a* and the plurality of electrodes 26*c* to e.g. an external power supply. In the case illustrated in FIG. 4, the plurality of electrodes 26*c* can be used as signal electrodes (positive electrodes) and electrically connected to e.g. the controller 5. Alternatively, the plurality of electrodes 26*c* can be used as ground electrodes and electrically connected to e.g. the support part 25*b* of the actuator plate 25.

The piezoelectric element 26 is mechanically connected to the support part 25*b* of the actuator plate 25. That is, the piezoelectric element 26 is electrically and mechanically connected to the support part 25*b* of the actuator plate 25. In this case, the piezoelectric element 26 may be electrically and mechanically connected to the support part 25*b* using a conductive adhesive. However, the distance between the electrode 26*a* and the electrode 26*c* is e.g. approximately 100 μm. Thus, when the piezoelectric element 26 is pressed to the support part 25*b* via the conductive adhesive, part of the conductive adhesive may extend around to the surface (side surface) of the piezoelectric element 26 crossing the surface on the support part 25*b* side. The end part of the electrode 26*a* is exposed to the surface of the piezoelectric element 26 crossing the surface on the support part 25*b* side. Thus, the electrode 26*c* and the electrode 26*a* may make a short circuit through the conductive adhesive. In this case, decreasing the amount of conductive adhesive may result in failing to achieve a sufficient bonding strength.

Thus, the nozzle head 2 according to this embodiment is provided with a fixing part 27 and a conductive part 28.

As shown in FIG. 4, the fixing part 27 is provided between each of a plurality of piezoelectric elements 26 and the support part 25*b* (actuator plate 25). The fixing part 27 is provided near the end part of the piezoelectric element 26 on the opposite side from the base part 25*a* side (nozzle plate 21 side). In this case, the support part 25*b* can be provided with a protrusion 25*ba*, and the fixing part 27 can be provided on the top surface of the protrusion 25*ba*. This can align the position of the fixing part 27, i.e., the fixing position of the plurality of piezoelectric elements 26. Furthermore, the end part of the piezoelectric element 26 on the opposite side from the base part 25*a* side can be caused to overhang from the protrusion 25*ba*. The piezoelectric element 26 is fixed to the support part 25*b* through the fixing part 27. The fixing part 27 is insulative. The fixing part 27 can be formed by e.g. curing an insulative adhesive. The adhesive can be e.g. thermosetting adhesive, ultraviolet-curable adhesive, or room temperature-curable adhesive. In the case of using a thermosetting adhesive, preferably, its curing temperature is half or less of the Curie point of the material of the piezoelectric part 26*b*. Use of an insulative adhesive can avoid short circuit between the electrode 26*c* and the electrode 26*a* even if part of the adhesive extends around to the surface of the piezoelectric element 26 crossing the surface on the support part 25*b* side when the piezoelectric element 26 is pressed to the support part 25*b*. Thus, the adhesive can be used in an amount necessary for obtaining a sufficient bonding strength.

The conductive part 28 is provided between each of a plurality of piezoelectric elements 26 and the support part 25*b* (actuator plate 25). The conductive part 28 is provided near the end part of the piezoelectric element 26 on the opposite side from the base part 25*a* side (nozzle plate 21 side). In this case, the conductive part 28 can be provided around the protrusion 25*ba*. This can align the position of the conductive part 28, i.e., the conducting position of the plurality of piezoelectric elements 26. The piezoelectric element 26 is electrically connected to the support part 25*b* through the conductive part 28. The conductive part 28 is conductive. The conductive part 28 can be formed by e.g. curing a conductive adhesive. The conductive adhesive can be e.g. an adhesive containing a filler made of carbon or metal, or a silver paste. As described above, the piezoelectric element 26 is connected by the fixing part 27. Thus, the conductive part 28 only needs to provide conduction between the piezoelectric element 26 and the support part 25*b*. Accordingly, the amount of conductive adhesive can be made smaller than in the case of providing bonding and conduction using a conductive adhesive. This can suppress that part of the conductive adhesive extends around to the surface of the piezoelectric element 26 crossing the surface on the support part 25*b* side when the piezoelectric element 26 is pressed to the support part 25*b*.

The conductive part 28 can be appropriately changed as long as it provides conduction between the piezoelectric element 26 and the support part 25*b*. For instance, the conductive part 28 may be e.g. a leaf spring or coil spring made of metal. The conductive part 28 may be e.g. a wiring connecting the piezoelectric element 26 and the support part 25*b*.

Figure 6A:
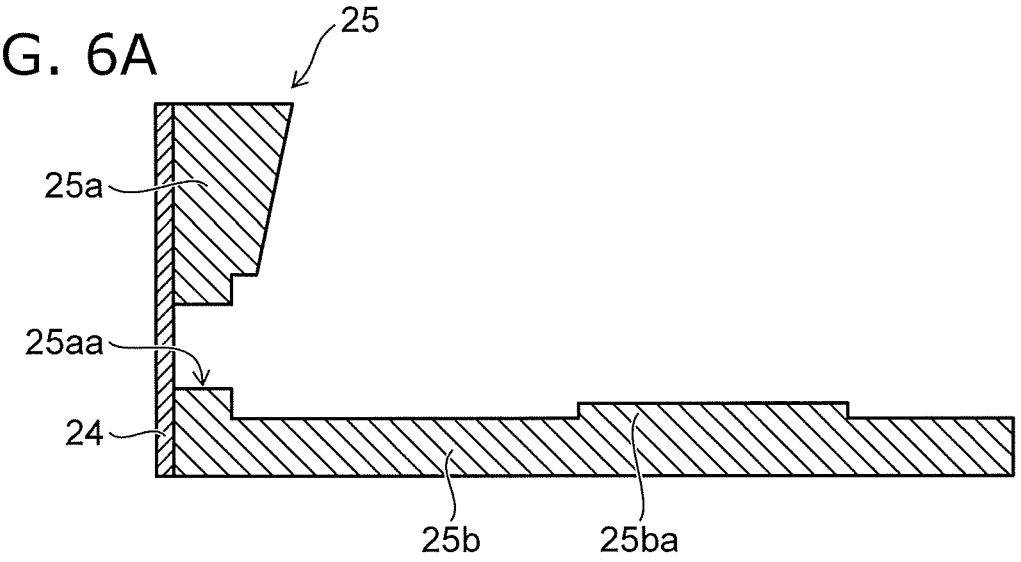
FIGS. 6A to 6C are schematic process sectional views for illustrating the formation of the fixing part and the conductive part.
Figure 6B:
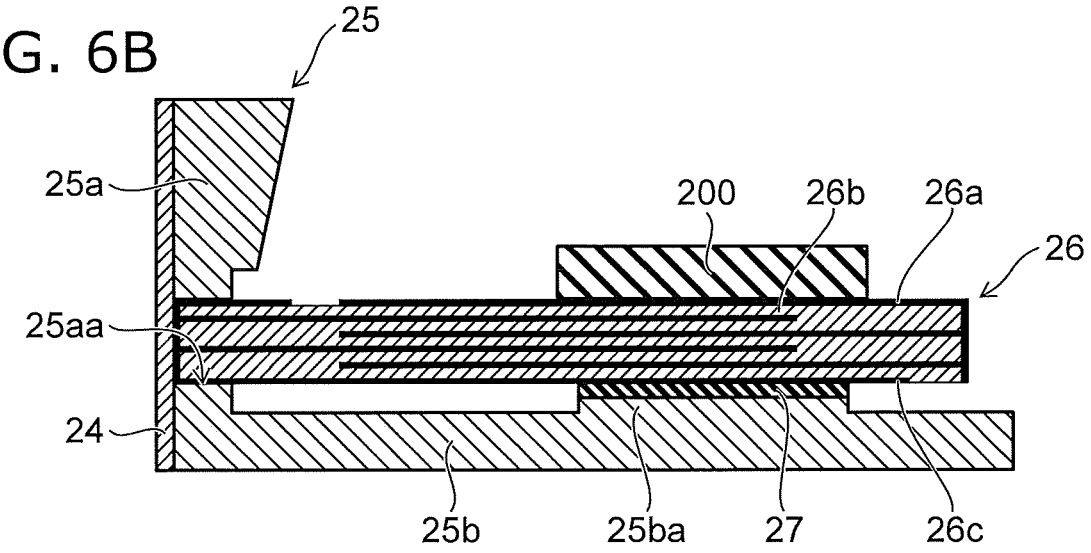
Figure 6C:
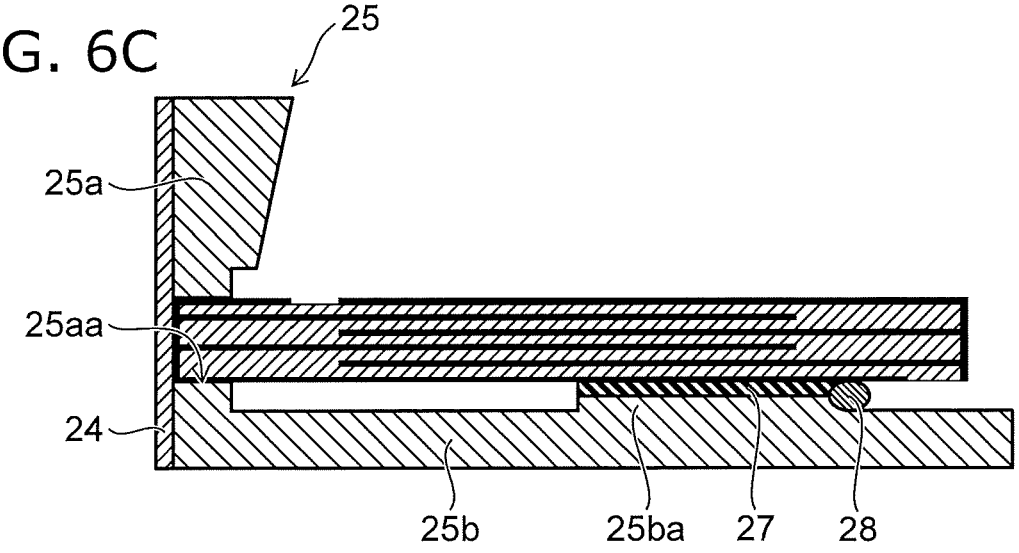

FIGS. 6A to 6C are schematic process sectional views for illustrating the formation of the fixing part 27 and the conductive part 28.

As shown in FIG. 6A, a diaphragm 24 is bonded to the end surface of the base part 25*a* on the opposite side from the protruding side of the support part 25*b*. For instance, the diaphragm 24 can be cemented to the end surface of the base part 25*a*.

Next, as shown in FIG. 6B, one end part of the piezoelectric element 26 is inserted into the hole 25*aa*. In this case, one end part of the piezoelectric element 26 is brought into contact with the diaphragm 24.

Subsequently, an insulative adhesive is supplied between the top surface of the protrusion 25*ba* and the piezoelectric element 26.

Subsequently, the piezoelectric element 26 is pressed to the support part 25*b* with a jig 200. The insulative adhesive is cured in this state.

The fixing part 27 can be formed in the foregoing manner.

Next, as shown in FIG. 6C, a conductive adhesive is supplied around the protrusion 25*ba*. Then, the conductive adhesive is cured to form a conductive part 28.

The adhesive for forming the fixing part 27 and the adhesive for forming the conductive part 28 can be supplied from e.g. a dispenser.

In the case where the conductive part 28 is e.g. a leaf spring, the conductive part 28 is bonded to the support part 25*b*. Subsequently, the piezoelectric element 26 may be inserted into the hole 25*aa*, and the fixing part 27 may be formed. Alternatively, after forming the fixing part 27, the conductive part 28 may be sandwiched between the piezoelectric element 26 and the support part 25*b*.

Next, returning to FIG. 1, the mounting part 3, the supply part 4, and the controller 5 are described.

The mounting part 3 mounts a target 100 and moves the target 100 in a prescribed direction. The mounting part 3 illustrated in FIG. 1 moves the target 100 in the X-axis direction. In this case, the mounting part 3 can be e.g. a uniaxial robot or conveyor. Alternatively, the mounting part 3 can move the target 100 in at least one of the X-axis direction and the Y-axis direction. In this case, the mounting part 3 can be e.g. an X-Y table. Alternatively, the mounting part 3 can move the target 100 in at least one of the X-axis direction, the Y-axis direction, and the Z-axis direction. In this case, the mounting part 3 can be e.g. a triaxial robot.

In the illustrated example, the target 100 moves below the nozzle head 2. However, the nozzle head 2 may move above the target 100.

The mounting part 3 can be provided with a holding part 31 as needed. The holding part 31 can be provided on e.g. the mounting surface for mounting the target 100. The holding part 31 can hold e.g. the end part of the target 100. For instance, the holding part 31 can be e.g. a mechanical chuck. Depending on the configuration and material of the target 100, the holding part thus provided can be e.g. a vacuum chuck or electrostatic chuck.

The supply part 4 is connected to the nozzle head 2 (the hole 22*a* of the flow channel plate 22) through a piping 43. The supply part 4 supplies a liquid material to the liquid chamber 21*b* of the nozzle plate 21.

The supply part 4 can be provided with a tank 41 and an open-close valve 42.

The tank 41 stores a liquid material. For instance, the tank 41 can be provided above the nozzle head 2. The tank 41 provided above the nozzle head 2 can supply the liquid material to the liquid chamber 21*b* of the nozzle plate 21 with the help of potential energy. In this case, a moving part can be provided to move the position of the tank 41 in the Z-axis direction.

Alternatively, the liquid material can be supplied from the tank 41 to the liquid chamber 21*b* of the nozzle plate 21 by providing a pump or supplying a gas into the tank 41.

One port of the open-close valve 42 is connected to the tank 41 through a piping 43. The other port of the open-close valve 42 is connected to the hole 22*a* of the flow channel plate 22 through a piping 43. The open-close valve 42 switches between the states of supplying and not supplying the liquid material. In addition, e.g. a control valve can be provided to control the pressure and flow rate of the liquid material.

The controller 5 can be provided with a computation part such as CPU (central processing unit) and a storage part such as a memory. The controller 5 controls the operation of each element provided in the droplet application device 1 based on the control program and data stored in the storage part. The control program for simply controlling the operation of each element can be based on known techniques. Thus, the detailed description thereof is omitted.

The dimension and shape of the target 100 are not particularly limited. For instance, the target may be a flat plate, and the application surface may be a generally flat surface. The application surface may be a curve surface, or may include irregularities or step differences. The material of the target 100 is not also particularly limited. The material of the target 100 may be any material to which the droplet can be attached.

The liquid material is not particularly limited as long as it can be discharged as droplets from the nozzle head 2. The liquid material can be e.g. ink, a film material used to form e.g. a resist film or color filter, thermosetting resin, ultraviolet-curable resin, liquid crystal material, electroluminescence material, and biological material. However, the liquid material is not limited to the foregoing examples.

The nozzle head 2 according to this embodiment can discharge droplets having a viscosity of 20 mPa·s or more, although it can discharge droplets having a viscosity less than 20 mPa·s.

For instance, the piezoelectric element 26 includes a plurality of electrodes 26*a*, a plurality of piezoelectric parts 26*b*, and a plurality of electrodes 26*c*. That is, the piezoelectric element 26 is a piezoelectric element having a stacked structure. Thus, compared with the piezoelectric element including one electrode 26*a*, one piezoelectric part 26*b*, and one electrode 26*c*, equal or larger displacement can be obtained even when the application voltage is lowered. As a result, even a liquid material having a viscosity of 20 mPa·s or more can be easily discharged from the nozzle hole 21*a*.

In this case, if the piezoelectric element 26 having a stacked structure is fixed to the support part 25*b* using a conductive adhesive, part of the conductive adhesive may extend around to the side surface of the piezoelectric element 26. Thus, the electrode 26*c* and the electrode 26*a* may make a short circuit. However, in the nozzle head 2 according to this embodiment, the piezoelectric element 26 is fixed to the support part 25*b* by the insulative fixing part 27. The piezoelectric element 26 is electrically connected to the support part 25*b* by the conductive part 28 having electrical conductivity. This can suppress the occurrence of e.g. short circuit even in the case of using the piezoelectric element 26 having a stacked structure.

In the piezoelectric element 26 having a stacked structure, a prescribed amount of droplets can be easily discharged even when the droplet has a viscosity of 20 mPa·s or more.

Figure 7:
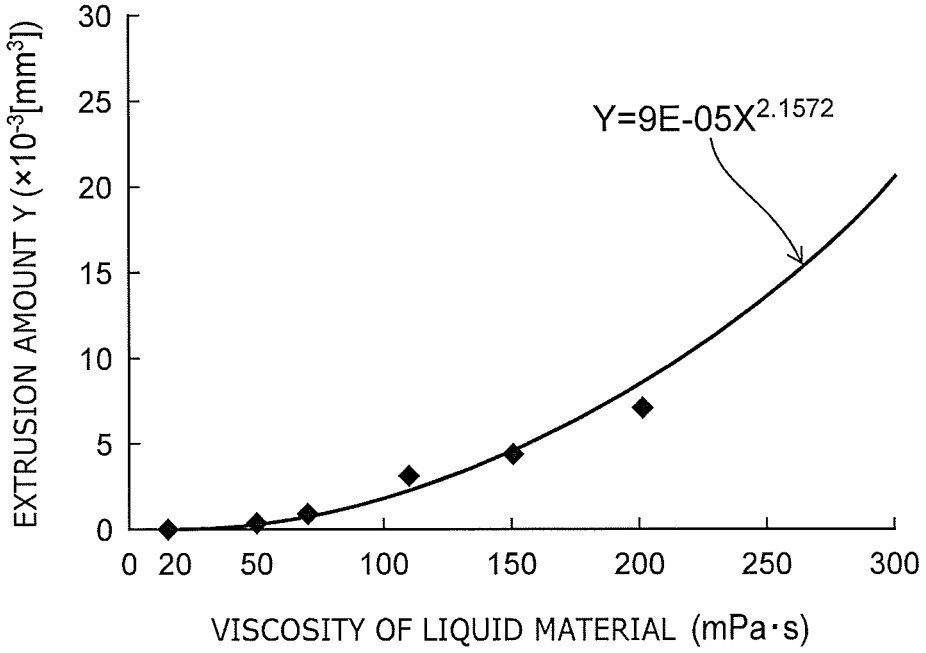
FIG. 7 is a graph for illustrating the relationship between the viscosity of the droplet and the extrusion amount.

FIG. 7 is a graph for illustrating the relationship between the viscosity of the droplet and the extrusion amount.

FIG. 7 shows the case of using the piezoelectric element 26 having a stacked structure.

When the viscosity of the droplet is high, the extrusion amount needs to be increased. In the piezoelectric element 26 according to this embodiment, the following formula is easily satisfied as shown in FIG. 7.

$$Y \geq 9E-05X^{2.1572}$$

Here, X (mPa·s) is the viscosity of the droplet, and Y ($mm^3$) is the extrusion amount.

As described above, the extrusion amount is the product of the cross-sectional area of the piezoelectric element 26 in the direction orthogonal to the central axis of the liquid chamber 21*b* and the displacement amount of the piezoelectric element 26.

As seen from FIG. 7, in the piezoelectric element 26 according to this embodiment, a prescribed amount of droplets can be easily discharged even when the liquid material has a viscosity of 20 mPa·s or more.

As seen from FIG. 7, the extrusion amount needs to be increased to discharge droplets having a viscosity of 20 mPa·s or more. When the extrusion amount is increased, mutual interference is more likely to occur between the adjacent liquid chambers 21*b*. The nozzle head 2 according to this embodiment is provided with a plurality of seal plates 23. This can suppress mutual interference between the adjacent liquid chambers 21*b* even when the extrusion amount is increased.

The storage part of the controller 5 can store data concerning the relationship between the viscosity of the droplet and the extrusion amount. The controller 5 can compute the extrusion amount from the inputted viscosity of the droplet and the data stored in the storage part. Based on the computed extrusion amount, the controller 5 can compute the displacement amount, and in addition, e.g. application voltage and application time.

For instance, the controller 5 can compute e.g. application voltage and application time so as to satisfy $Y \geq 9E-05X^{2.1572}$.

Then, the controller 5 can control the displacement amount of the piezoelectric element 26 based on e.g. the computed application voltage and application time so as to discharge droplets appropriately.

That is, the controller 5 can control at least one of the applied voltage and the application time of the voltage for each of a plurality of piezoelectric elements 26 provided in the nozzle head 2. The controller 5 can control at least one of the voltage and the application time of the voltage so as to satisfy $Y \geq 9E-05X^{2.1572}$.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A nozzle head comprising:

a nozzle plate including a plurality of nozzle holes capable of discharging droplets;

a piezoelectric element including a plurality of first electrodes and a plurality of second electrodes provided alternately and a piezoelectric part provided between the plurality of first electrodes and the plurality of second electrodes, the piezoelectric element being provided for each of the plurality of nozzle holes;

an actuator plate provided on opposite side of the nozzle plate from a side to which the plurality of nozzle holes are opened, the actuator plate comprising a support part including a protrusion extending above a main surface of the actuator plate;

a fixing part being insulative and provided on the protrusion, the fixing part being configured to fix each of a plurality of the piezoelectric elements to the support part; and a conductive part being conductive and provided in direct contact with a side surface of the protrusion and in direct contact with a side surface of the fixing part, the conductive part being configured to electrically connect each of a plurality of the piezoelectric elements to the support part.

2. The nozzle head according to claim 1, wherein number of the plurality of first electrodes is odd.

3. The nozzle head according to claim 1, wherein number of the plurality of second electrodes is odd.

4. The nozzle head according to claim 1, further comprising:

a plurality of seal plates provided between the nozzle plate and the actuator plate and being thinner than thickness of the nozzle plate.

5. The nozzle head according to claim 4, wherein the seal plate has a thickness of 0.1 mm or less.

6. The nozzle head according to claim 1, wherein the actuator plate is provided with a protrusion, and the fixing part is provided on a top surface of the protrusion.

7. The nozzle head according to claim 1, wherein the fixing part is formed by curing a thermosetting adhesive, and curing temperature of the thermosetting adhesive is half or less of Curie point of material of the piezoelectric part.

8. The nozzle head according to claim 1, wherein the actuator plate is provided with a protrusion, and the conductive part is provided around the protrusion.

9. The nozzle head according to claim 1, wherein the conductive part is formed by curing a conductive adhesive.

10. The nozzle head according to claim 1, wherein the conductive part is a leaf spring or a coil spring.

11. The nozzle head according to claim 1, wherein the droplet has a viscosity of 20 mPa·s or more.

12. A droplet application device comprising:

the nozzle head according to claim 1; and a controller capable of controlling at least one of applied voltage and application time of the voltage for each of the plurality of piezoelectric elements provided in the nozzle head, the controller being capable of controlling at least one of the voltage and the application time of the voltage so as to satisfy a following formula $$Y \geq 9E-05X^{2.1572}$$

where X (mPa·s) is viscosity of the droplet, and Y ($mm^3$) is extrusion amount.

13. A nozzle head comprising:

a nozzle plate including a plurality of nozzle holes capable of discharging droplets;

a piezoelectric element including a plurality of first electrodes and a plurality of second electrodes provided alternately and a piezoelectric part provided between the plurality of first electrodes and the plurality of second electrodes, the piezoelectric element being provided for each of the plurality of nozzle holes;

an actuator plate provided on opposite side of the nozzle plate from a side to which the plurality of nozzle holes are opened; and a plurality of seal plates provided between the nozzle plate and the actuator plate and being thinner than thickness of the nozzle plate, the plurality of seal plates being in direct contact with each other.

14. The nozzle head according to claim 13, wherein number of the plurality of first electrodes is odd.

15. The nozzle head according to claim 13, wherein number of the plurality of second electrodes is odd.

16. The nozzle head according to claim 13, wherein the seal plate has a thickness of 0.1 mm or less.

17. The nozzle head according to claim 13, wherein the droplet has a viscosity of 20 mPa·s or more.

18. A droplet application device comprising:

the nozzle head according to claim 14; and a controller capable of controlling at least one of applied voltage and application time of the voltage for each of a plurality of piezoelectric elements provided in the nozzle head, the controller being capable of controlling at least one of the voltage and the application time of the voltage so as to satisfy a following formula $$Y \geq 9E-05X^{2.1572}$$

where X (mPa·s) is viscosity of the droplet, and Y ($mm^3$) is extrusion amount.

* * * * *